US009110423B1

(12) United States Patent
Bartle

(10) Patent No.: US 9,110,423 B1
(45) Date of Patent: Aug. 18, 2015

(54) METHOD AND APPARATUS FOR DETERMINING AN AMOUNT OF TONER WITHIN A TONER CARTRIDGE BASED ON ACOUSTIC PROPERTIES OF THE TONER CARTRIDGE

(71) Applicant: Marvell International Ltd., Hamilton (BM)

(72) Inventor: David A. Bartle, Boise, ID (US)

(73) Assignee: Marvell International Ltd., Hamilton (BM)

( * ) Notice: Subject to any disclaimer, the term of this patent is extended or adjusted under 35 U.S.C. 154(b) by 0 days.

(21) Appl. No.: 14/151,091

(22) Filed: Jan. 9, 2014

Related U.S. Application Data

(60) Provisional application No. 61/750,891, filed on Jan. 10, 2013.

(51) Int. Cl.
*G03G 15/08* (2006.01)
*G03G 15/00* (2006.01)

(52) U.S. Cl.
CPC ..... *G03G 15/556* (2013.01)

(58) Field of Classification Search
USPC ..... 399/9, 12, 24, 25, 27–30
See application file for complete search history.

(56) References Cited

U.S. PATENT DOCUMENTS

| | | | | |
|---|---|---|---|---|
| 4,313,343 | A * | 2/1982 | Kobayashi et al. | 73/290 V |
| 7,062,182 | B2 * | 6/2006 | Ito et al. | 399/27 |
| 2002/0154915 | A1 * | 10/2002 | Bullock et al. | 399/12 |

* cited by examiner

*Primary Examiner* — Hoan Tran

(57) ABSTRACT

Various techniques are described for acoustically exciting a toner cartridge and acoustically measuring an amount of ink or toner in a toner cartridge by using known resonant shaping structures built into the toner cartridge. As ink or toner is consumed, a resonant shaping structure covered by the ink or toner is partially revealed, changing an acoustic signature received from the toner cartridge. A current level of ink or toner is determined by analyzing the acoustic signature. The current level is used to calibrate a relationship function used to estimate a remaining number of pages that can be printed based on the level of ink or toner remaining in the toner cartridge.

18 Claims, 5 Drawing Sheets

METHOD AND APPARATUS FOR DETERMINING AN AMOUNT OF TONER WITHIN A TONER CARTRIDGE BASED ON ACOUSTIC PROPERTIES OF THE TONER CARTRIDGE

CROSS REFERENCE TO RELATED APPLICATIONS

The present disclosure claims priority to U.S. Provisional Patent Application No. 61/750,891, filed Jan. 10, 2013, which is incorporated herein by reference.

BACKGROUND

Printer manufacturers provide printing devices that measure a remaining amount of ink or toner (e.g., consumable supplies) in a toner cartridge toner cartridge, and communicate this information to a user. For example, a user may desire a printing device to provide information on whether there is enough toner left to print, for example, a 100 page document. So a basic problem facing printer manufacturers is accurately determining how much ink or toner is actually left in a toner cartridge.

For laser printers, "pixel counting" estimation methods are often used to measure a remaining amount of toner by tracking an "on time" of a video signal waveform used to charge an optical photo conductor drum. The photo conductor drum is written on by, for example, a laser, changing a charge on the drum at various locations to attract toner and transfer it to a sheet of paper. A signature of the laser of the drum is then used to determine how much toner has been attracted. However, the relationship between laser signature, and an amount of toner used, is a function of factors such as drum age, ambient humidity, ambient temperature, and other factors. Thus, "pixel counting" techniques are not highly accurate. Other techniques may simply count pages, measure contone values of the input image or use a light source and photocell receptor to estimate a remaining fill level of toner or ink in a toner cartridge. However, these techniques are also not highly accurate. Generally, factory measurements relating ink or toner usage are preformed, and the product is shipped with a relationship function programmed into firmware that provides an estimation of a remaining number of pages that can be printed based on current usage.

SUMMARY

In various embodiments, the present disclosure provides a method and apparatus for exciting the toner cartridge with an acoustic signal, based on having excited the toner cartridge with the acoustic signal, receiving a response to the acoustic signal and analyzing the response to the acoustic signal to determine the amount of toner remaining in the toner cartridge.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
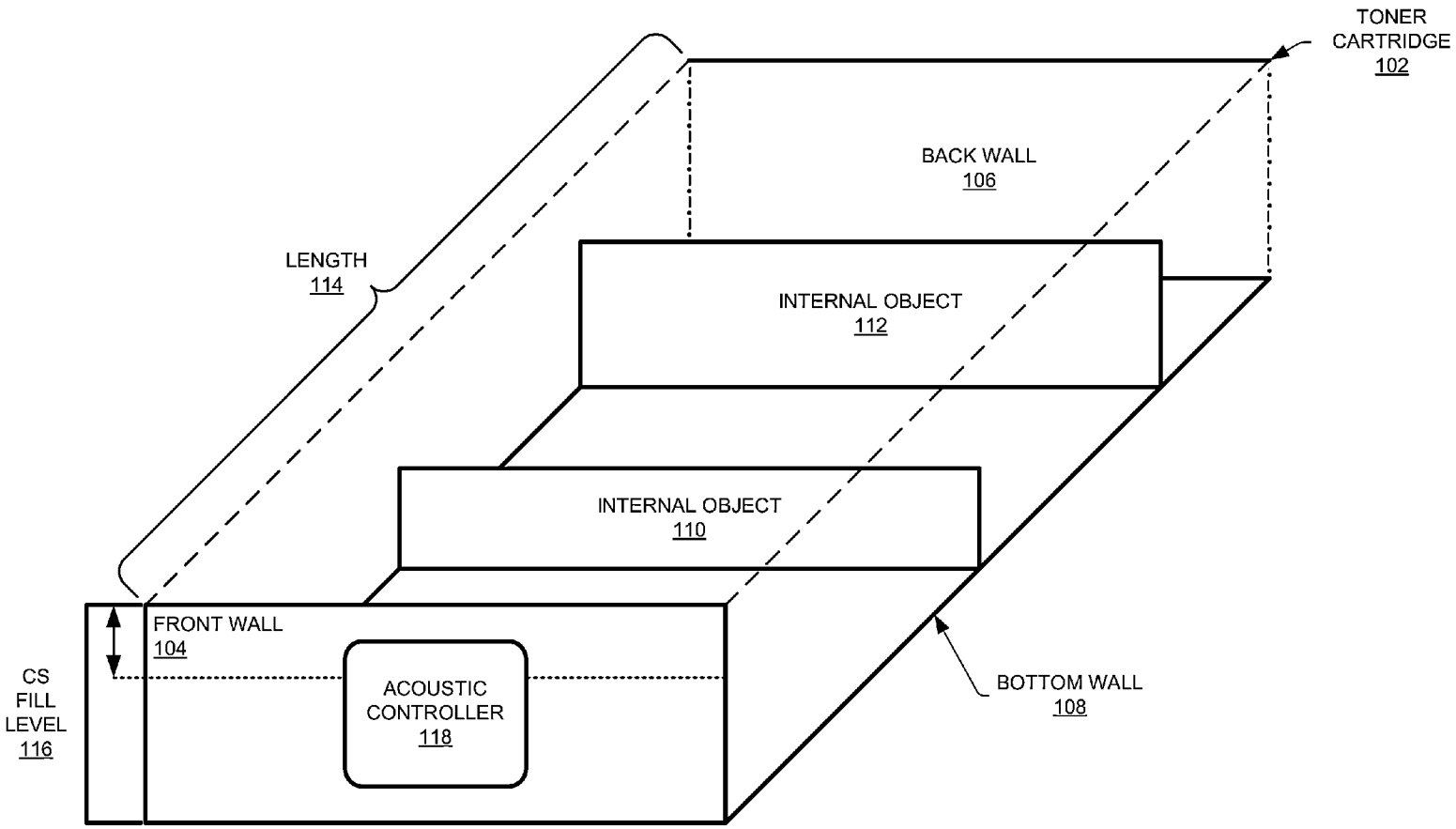
FIG. 1 schematically illustrates an example cut-away view of a toner cartridge.

As previously described, current solutions for estimating a remaining amount of consumable supplies (e.g., ink, toner, etc.) in a toner cartridge suffer from accuracy problems as the current solutions implement "pixel counting" or other inaccurate techniques. In various embodiments, the present disclosure describes methods that use acoustic techniques to measure a remaining amount of consumable supplies available for use by a printing device, and refine an estimate of a remaining number of output elements (e.g., pages) that may be printed at a suitable level of quality.

Enclosed structures, such as toner cartridges, have properties of acoustic resonance. Based on characteristics of a toner cartridge (e.g., dimensions, internal objects or barriers within the toner cartridge, materials within the toner cartridge), resonant characteristics (or properties) of the toner cartridge are determined. Thus, a toner cartridge is utilized that has acoustic reflection and resonance characteristics that are precisely defined by an internal geometry of the toner cartridge, and also by the amount of consumable supplies residing in the toner cartridge.

An acoustic signal source is used to excite sound waves in the toner cartridge to generate an acoustic response. An acoustic transducer (e.g., microphone) and accompanying signal processing hardware are used to receive and analyze the response to accurately estimate a volume of consumable supplies inside the toner cartridge. The acoustic measuring techniques described herein are used to estimate the volume of consumable supplies with a high degree of accuracy (e.g., ≥4 decimal points of volume and/or level measurement accuracy).

Resonant shaping of the internal physical structure in the toner cartridge is performed such that resonant frequencies detected will change in very predictable ways as consumable supplies are consumed. Resonant shaping structures built inside the cavity of the toner cartridge are "buried" or invisible to the acoustic signal when the toner cartridge is full, and have no effect on the resonant response measured when acoustic energy is introduced to the cavity of the toner cartridge by the acoustic signal source.

As consumable supplies are consumed, one or more buried resonant shaping structures will emerge, resulting in a change in the measured resonant response. This change is detected to provide an accurate measurement of a volume or fill level of consumable supplies remaining in the toner cartridge. As consumable supplies are further consumed, additional buried resonant shaping structures will emerge, and further changes in the measured resonant response are detected. This provides additional accurate measurements of the volume of consumable supplies remaining in the toner cartridge.

For a given toner cartridge (e.g., new or refilled), a number of output elements (e.g., pages) printed is maintained and associated with the acoustic measurements of the volume of consumable supplies remaining in the toner cartridge. These acoustic measurements are used to calibrate, or re-calibrate, a relationship function used to generate an estimate of a remaining number of output elements that may be printed at a suitable level of quality by the printing device using the given toner cartridge.

As an example, acoustic measurements are used to correlate toner usage to pages printed, generate a better estimation of an amount of toner used, estimate an amount of toner remaining and estimate a number of pages remaining for a given amount of toner remaining. Therefore, acoustic measurements are used to calibrate the relationship function to create better estimations of toner usage per pages printed. These calibrated relationship functions are maintained, refill after refill, such that continuous improvement of the accuracy of the relationship functions is provided over the life of the toner cartridge. In addition, heuristics (e.g., calibrated relationship functions) can also be maintained and improved for a given printer using different toner cartridges.

Example Environment

FIG. 1 is a schematic diagram of an example cut away view of a toner cartridge 102. Toner cartridges containing ink, toner or other materials come in many different shapes (e.g., cylindrical, square, rectangular, etc.) and sizes. Example toner cartridge 102 is illustrated as rectangular for purposes of discussion.

Toner cartridge 102 is an enclosed structure with an internal cavity that includes a front wall 104, a back wall 106 and a bottom wall 108. Toner cartridge 102 is further enclosed by side walls and a top wall shown as transparent in FIG. 1 for purposes of illustration. Example toner cartridge 102 further include resonance shaping structures, such as internal object 110 and internal object 112, positioned internally along length 114 of toner cartridge 102. For purposes of illustration, internal objects 110 and 112 are shown as internal walls connected to bottom wall 108, as well as the side walls. However, this is not a limitation, as other internal geometries are with the scope of this disclosure. As an example, only two internal objects 110 and 112 are shown in FIG. 1, however, numerous other shapes, structures, sizes and numbers of internal objects (e.g., resonance shaping structures) connected in any fashion to an internal cavity of print cartridge 102 are within the scope of this disclosure. As an example, resonance shaping structures can be incorporated into an internal shaping of print cartridge 102, and can include substantially comb-like structure(s), triangular structure(s), elliptical structure(s), spherical structure(s), or any type of internal configuration suitable for resonance shaping.

As an example, internal object 110 has a height that is less than a height of internal object 112. Both internal object 110 and internal object 112 are illustrated as having a height that is less than the height of front wall 104 and/or back wall 106. FIG. 1 illustrates only two internal objects; however, this is not a limitation, as various numbers of internal objects in various configurations are within the scope of this disclosure.

For purposes of discussion, toner cartridge 102 will be described as containing toner, at variable consumable supply (CS) fill levels 116, consistent with the orientation of toner cartridge 102 as illustrated in FIG. 1. However, toner cartridge 102 can also contain ink or other consumable supply compounds, such as materials suitable to facilitate 3-dimensional (3-D) printing. Moreover, toner cartridge 102 can be operated in other orientations, such as turned 90 degrees, 180 degrees or 270 degrees. CS fill level 116 would then be measured corresponding to the orientation of toner cartridge 102.

When toner cartridge 102 is newly filled with toner, CS fill level 116 is at a high level, near the top of front wall 104 and/or back wall 106. In various embodiments, when CS fill level 116 is high, internal object 110 and internal object 112 are submersed in (e.g., buried by, covered with) toner, or other suitable consumable supply. Thus, toner cartridge 102 includes an enclosed volume that has acoustic reflection and resonance characteristics that are precisely defined by the internal geometry of the cavity of toner cartridge 102, internal objects 110 and 112, as well as an amount of CS (e.g., toner) residing in the enclosed structure of toner cartridge 102. As an example, to control acoustic resonance characteristics of toner cartridge 102, internal object 110 is positioned at one third of length 114 from front wall 104 to back wall 106 and internal object 112 is positioned at two thirds of length 114 from front wall 104 to back wall 106.

In various embodiments, acoustic controller 118 is a semiconductor based device (e.g., semiconductor chip, application-specific integrated circuit (ASIC), system on a chip (SoC), or the like) that generates, receives, controls and processes acoustic measurements of toner cartridge 102. Acoustic controller 118 generates, or controls the generation of, an acoustic signal that propagates through the internal cavity of toner cartridge 102. Acoustic controller 118 receives and processes corresponding reflections (e.g., resonances) of the generated acoustic signal to determine acoustic reflection and resonance characteristics in the cavity of toner cartridge 102. In various embodiments, acoustic controller 118 is attached to, or integrated with, toner cartridge 102. In the example of FIG. 1, acoustic controller 118 is shown attached to, or integrated into front wall 104, although numerous other varied points of integration are within the scope of this disclosure. Acoustic controller 118 is shown in FIG. 1 as a single entity, however, acoustic controller 118 can contain various components attached to, or integrated with, toner cartridge 102 at various different locations.

Figure 2:
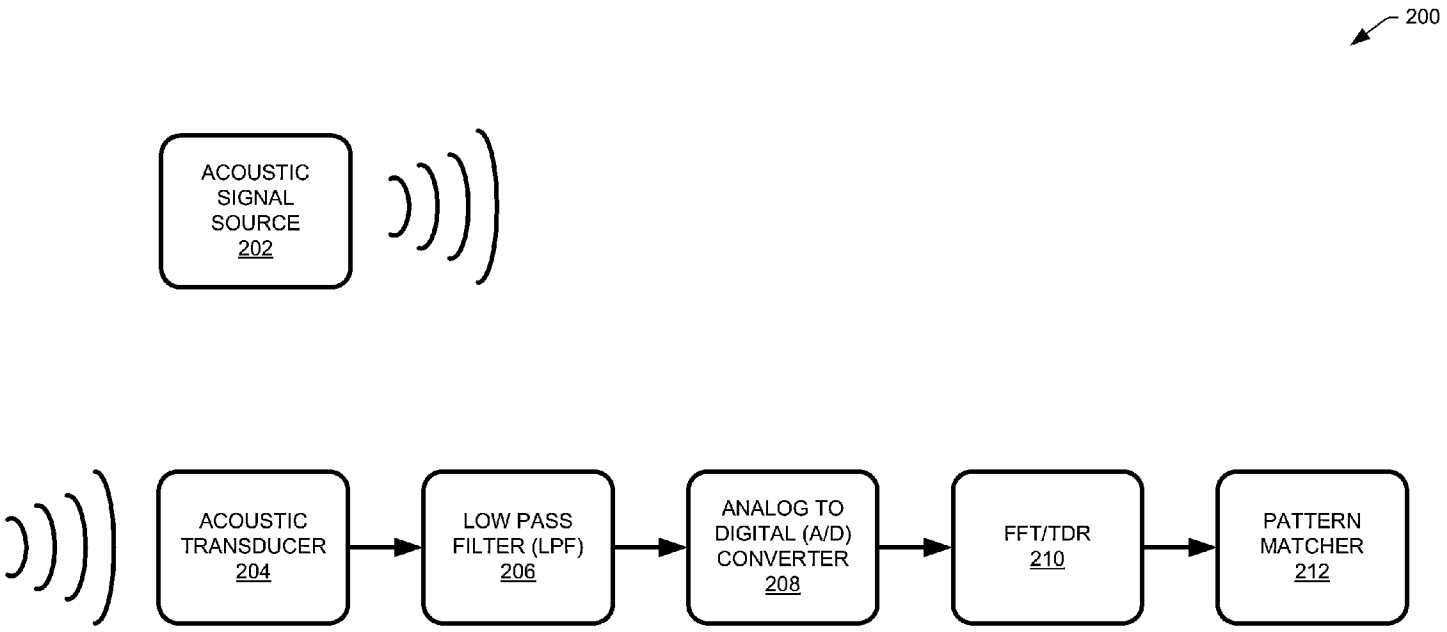
FIG. 2 is a block diagram that illustrates operational functions and components of an acoustic controller.

FIG. 2 is a block diagram 200 that illustrates an example of various operational functions and components of acoustic controller 118. As an example, acoustic controller 118 includes or controls an acoustic signal source 202 that emanates an acoustic signal to excite sound waves in the internal structure of toner cartridge 102. Acoustic controller 118 also includes or controls an acoustic transducer 204 (e.g., microphone). Acoustic controller 118 also includes accompanying signal processing hardware, software and/or firmware to receive and analyze a response to the acoustic signal source, to accurately estimate the volume, and/or CS fill level 116 of consumable supplies inside toner cartridge 102.

As an example, acoustic signal source 202 generates a swept "chirp" signal, ping, pulse, shaped pulse, impulse(s), or the like, to excite known available resonances in an internal cavity of toner cartridge 102. As an example, and not a limitation, acoustic signal source 202 generates a signal over one or more durations corresponding to resonant frequencies that are custom to the internal geometrical configuration of toner cartridge 102 for performing resonance measurements to determine, for example, a volume or fill level of consumable supplies inside toner cartridge 102. Acoustic transducer 204 (e.g., microphone) converts sound (e.g., sound reflections produced in toner cartridge 102 by acoustic signal source 202) to electric energy (e.g., an associated electric signal waveform).

Low pass filter (LPF) 206 is in general an analog LPF for filtering the electric signal waveform generated by acoustic transducer 204. LPF 206 is used to reduce noise, unwanted higher harmonics, and/or to satisfy sampling frequency requirements of analog-to-digital (A/D) converter 208. A/D converter 208 converts analog samples of the detected filtered electric signal waveform to digital values. Fast Fourier Transform (FFT)/Time-Domain Reflectometer (TDR) 210 performs FFT and/or TDR measurements on digital values from A/D converter 208 (or TDR measurements on the analog waveform from LPF 206) to generate a pattern indicative of a fill level of toner in toner cartridge 102.

In various embodiments, FFT/TDR 210 operates in an FFT mode to perform data windowing and FFT operations to convert the time domain digital values from A/D converter 208 to the frequency domain to generate a spectral pattern associated with the acoustic signal detected by acoustic transducer 204.

In various embodiments, FFT/TDR 210 operates in a TDR mode to perform time-domain reflectometry measurements to generate a time-domain pattern associated with reflections of the acoustic signal detected by acoustic transducer 204. When operating in a time-domain mode, FFT/TDR 210 can process the analog signal directly from LPF 206, bypassing A/D converter 208. Optionally, when operating in the time-domain mode (e.g., TDR mode), FFT/TDR 210 can use A/D converter 208 to generate digital values to represent a pattern associated with the acoustic signal detected by acoustic transducer 204.

Therefore, FFT/TDR 210 operates in a frequency domain mode (e.g., FFT), time-domain mode (e.g., TDR), or combinations thereof. Alternatively, FFT/TDR 210 operates in one of and FFT mode or a TDR mode.

Pattern matcher 212 compares patterns generated by FFT/TDR 210 to known patterns (e.g., stored patterns) corresponding to various CS fill levels 116 in toner cartridge 102. In comparing patterns generated by FFT/TDR 210 to known patterns, pattern matcher 212 uses heuristics or other pattern matching techniques to determine, for example, CS fill level 116 (e.g., a volume of toner in toner cartridge 102).

As an example, for FFT/TDR 210 configured in FFT mode, pattern matcher 212 compares the measured spectral pattern generated by FFT/TDR 210 to known spectrums from various CS fill levels 116 in toner cartridge 102. In this example, pattern matcher 212 uses heuristics or other techniques to determine CS fill level 116 by comparing the measured spectral pattern generated by FFT/TDR 210 to known spectral patterns stored, inferred or derived by pattern matcher 212.

In various embodiments, pattern matcher 212 maintains a number of known patterns associated with known CS fill levels 116, as well as maintaining a store of measured patterns. Toner cartridge manufacturers, users, or the like, can access and analyze such maintained data to improve operational performance of a printing device that uses toner cartridge 102, to improve a design of toner cartridge 102, to determine most suitable consumable supplies (e.g., type of toner) for use in toner cartridge 102, to improve pixel counting estimations, and/or the like.

In various embodiments, pattern matcher 212 maintains information that allows for tracking changes in relationships between measured spectral patterns generated by FFT/TDR 210 to known spectrums from various CS fill levels 116 in toner cartridge 102 over time. Thus, pattern matcher 212 maintains information over time (e.g., between refills of toner cartridge 102, information associated with time, days, weeks, months of the year, etc.) to allow a user to monitor increases or decreases of toner usage per number of printed pages, rates of toner usage over time, and/or the like. Such information allows a user to determine, or be made aware of, a change in ambient environmental conditions, a health (e.g., operational condition) of various components (e.g., optical photo conductor drum of a laser printer) of the printing device, or other factors associated with rates of change of toner usage.

As an example, acoustic controller 118 determines, or is notified when toner cartridge 102 has been refilled, to what capacity, and how many times a refill has occurred. By maintaining information on toner usage over time (e.g., in non-volatile memory of acoustic controller 118), the accuracy of the estimate continuously improves over the life of toner cartridge 102.

Referring back to FIG. 1, by utilizing resonant shaping of the physical structure in toner cartridge 102, the resonant frequencies present will change in very predictable ways as consumable supplies (e.g., toner) are consumed. The resonant shaping structures (e.g., internal objects 110 and 112) will be "buried" or invisible to the acoustic signal source 202 when the cartridge is full, and have no effect on the resonant response measured when the acoustic energy is introduced to the cavity of toner cartridge 102.

Therefore, if the toner in toner cartridge 102 is completely covering internal object 110 and internal object 112, these internal objects will not affect the resonance of the cavity. In general, the resonance in the longitudinal direction is determined solely by the length (e.g., length 114) of the trough. However, when toner is consumed to initially expose the first higher structure (e.g., internal object 112), a secondary resonant frequency will appear. As more toner is consumed, the magnitude of the secondary resonant frequency from the first structure will increase, and will soon be joined by a third resonant frequency generated as the second resonant shaping structure (e.g., internal object 110) is exposed.

With the use of various acoustic structures (e.g., internal object 110 and internal object 112) in the cavity, known fill levels of remaining toner associated with the internal objects are easily determined. In various embodiments, such known fill levels are used to calibrate, or re-calibrate, a relationship function used to estimate of a number of remaining pages that can be printed at a current fill level of toner cartridge 102. Therefore, by recording the actual number of pages printed when various fill levels (e.g., CS fill levels 116) are detected, an accurate "estimate to empty" (e.g., the fill level at which print quality is compromised) can be determined.

Example Relationship Function Calibration

Often, with laser printers, imaging pipeline firmware uses "pixel counting" techniques to determine a relationship (e.g., relationship function) between toner usage and pages printed. Such a relationship function is used, for example, to estimate how many more pages can be printed before the toner is substantively consumed. However, such pixel counting techniques are generally inaccurate, often because of environmental and other factors. Techniques are described herein for calibrating and/or re-calibrating the relationship function to greatly improve the estimate of how many more pages can be printed before the toner is substantively consumed. The techniques employ the acoustic measurements described herein to determine remaining toner volume with greater accuracy relative to estimates of remaining toner volume generated by "pixel counting" techniques alone.

Figure 3:
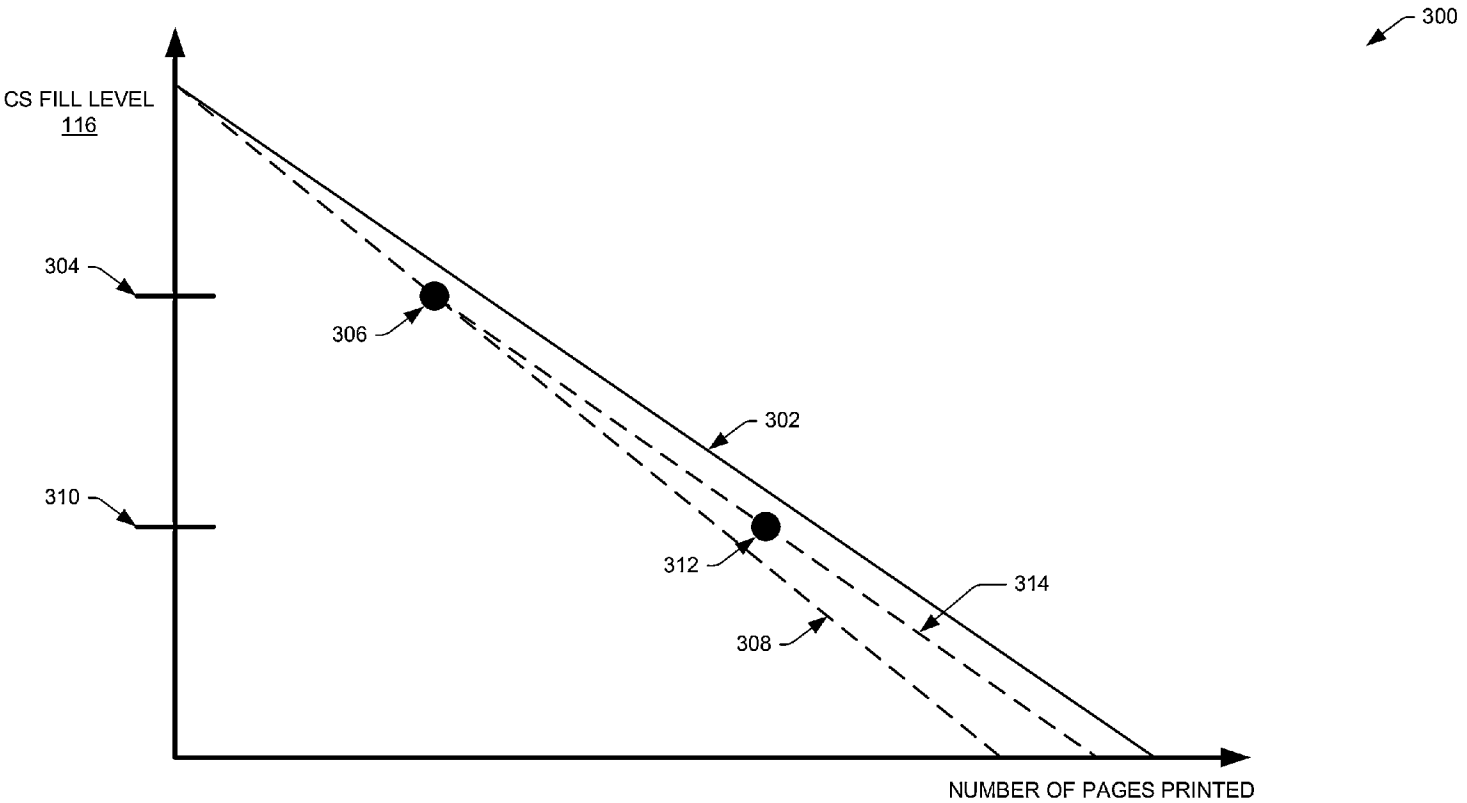
FIG. 3 is a diagram showing an example of calibrating a relationship function.

FIG. 3 depicts an example environment 300 of graphically illustrating relationships between a fill level of consumable supplies (e.g., CS fill level 116) and output elements (e.g., pages) printed by a printing device (e.g., laser printer, ink printer, copier, fax, 3-D printer, etc.) using a toner cartridge, such as toner cartridge 102. As an example, the x-axis of the graph of FIG. 3 represents a number of output elements for printing and the y-axis represents a fill level of consumable supplies (e.g., CS fill level 116). For simplicity of discussion, pages and output elements, as well as consumable supplies and toner, will be used interchangeably.

As an example, relationship line 302 represents a factory calibrated relationship (e.g., associated with a relationship function), between an expected toner fill level and a given number of printed pages for a new toner cartridge 102 that contains toner at an initial fill level (e.g., an unused newly filled or newly refilled toner cartridge). Therefore, as printed pages are counted for a new toner cartridge 102, starting from an initial fill level, relationship line 302 is used to estimate a remaining number of pages that may be printed before toner cartridge 102 is effectively depleted or at a fill level that does not support a quality printout (e.g., at an end fill level without enough ink or toner to mark a page properly). The estimated number of remaining pages can be output on a display by the printing device for a user.

As described above, for laser printers, pixel counting techniques are used to estimate remaining toner. Based on a number of factors, including environmental factors, component variation, component aging, differences in paper quality, etc., pixel counting must be calibrated for a printing device as well as the components of the printing device. This calibration is similar for both toner and ink (e.g., a liquid, a semi-liquid); however, each uses different physical mechanisms. Therefore, based on these various factors, or other factors, acoustic measurements are performed to facilitate a calibration of relationship line 302 to allow for a more accurate estimation of a number of remaining pages that can be printed for a current fill level (e.g., current CS fill level 116) of toner cartridge 102.

As an example, an acoustic measurement, as described herein using acoustic controller 118, is performed on toner cartridge 102 to determine a CS fill level 116 as point 304 on the graph in FIG. 3. An associated number of pages printed starting from an initial, or refilled toner cartridge 102 is determined along the x-axis, resulting in the determination of point 306. As an example, point 304 is determined by detecting, in a response (e.g., reflection of an acoustic signal generated by acoustic signal source 202 and received by acoustic transducer 204), a first resonant shaping structure (e.g., internal object 112) submerged in the consumable supplies of toner cartridge 102 at a fill level (e.g., toner fill level) that reveals at least a portion of the first resonant shaping structure.

For example, as toner is consumed in toner cartridge 102, a top portion of internal object 112 will appear through the toner at a particular toner fill level. Acoustic controller 118 detects an acoustic signature (e.g., a change in the waveform provided by acoustic transducer 204) at a toner fill level that reveals at least a portion of internal object 112. As an example, the toner fill level that reveals at least a portion of internal object 112 is a known toner fill level, such as point 304. Thus, point 304 corresponds to a current fill level of toner cartridge 102.

Using the results of the acoustic measurement, acoustic controller 118 calibrates relationship line 302 (e.g., modifies a relationship function associated with relationship line 302), for example, to generate a new relationship line 308 corresponding to toner fill level 304 and the known number of pages printed associated with point 306. The calibration of relationship line 302, to generate a new relationship line 308 (e.g., a calibrated relationship function), can be performed in numerous fashions. FIG. 3 illustrates a simple example calibration of relationship line 302 by shifting relationship line 302 to pass through point 306 to generate new relationship line 308. Numerous different types of calibration can be used to transform relationship line 302 to a new relationship line 308. A goal of calibration of relationship line 302 is to generate new relationship line 308 using point 306 to provide a better estimate of a number of remaining pages that can be printed based on known CS fill level 304.

At a later time, as toner is further consumed, an acoustic measurement is performed by acoustic controller 118 that detects at least a portion of a second resonant shaping structure (e.g., internal object 110) submerged in the consumable supplies of toner cartridge 102 at known fill level 310. Thus, known fill level 310 corresponds to a current fill level of toner cartridge 102. An associated known number of printed pages is shown corresponding to point 312. As an example, relationship line 308 (or relationship line 302) is re-calibrated, for example, to generate a new relationship line 314 (e.g., a calibrated relationship function) using, for example, points 306 and 312. Numerous different types of re-calibration can be used to transform relationship line 308 to a new relationship line 314. A goal of calibration of relationship line 302 is to generate new relationship line 314 using, as an example, points 306 and 312 to provide a better estimate of a number of remaining pages that may be printed based on known CS fill levels 304 and 310.

As toner is further consumed, toner cartridge 102 will eventually become effectively empty (e.g., an end fill level), and will need to be refilled back to an initial fill level. Acoustic controller 118 is configured to remember the calibrated relationship function, for example, the calibrated relationship function associated with relationship line 314. Therefore, when toner cartridge 102 is put back into service in the printing device after refill, the calibrated relationship function will be used. As an example, after refill of toner cartridge 102, the calibrated relationship function associated with relationship line 314 effectively becomes a current relationship line 302, such that relationship line 314 is subjected to calibration and/or re-calibration between an initial fill level and an end fill level of toner cartridge 102 after refill. This process continues for each refill of toner cartridge 102. Thus, the estimation of the remaining number of pages that can be printed using toner cartridge 102 between initial and end fill levels continuously improves over the life of toner cartridge 102, refill after refill.

Example environment 300 illustrates example techniques for re-calibrating an estimation of a number of pages that can be printed for a given toner cartridge. As an example, numerous acoustic measurement points may be utilized (e.g., every 10 pages, 100 pages, etc.), such that numerous techniques, for example, linear regression, or other techniques may be used to re-calibrate relationship line 302. A frequency of acoustic measurements can be adjusted based at least in part on determining a deviation from an estimated relationship between toner fill level and pages printed. As an example, a distance of points 306 and 312 from corresponding points on relationship line 302 causes a frequency of acoustic measurements to increase proportional to a magnitude of the distance of points 306 and 312 from corresponding points on relationship line 302.

Thus, acoustic controller 118 performs the acoustic measurements on a predetermined periodic basis, or at intervals determined by acoustic controller 118. As an example, if the number of printed pages at point 306 deviates from the estimated number of printed pages on relationship line 302, acoustic controller 118 increases the frequency of acoustic measurements as a function of the magnitude of the deviation.

Additionally, acoustic controller 118 changes the frequency of acoustic measurements as a function of a number of resonant shaping structures (e.g., internal objects 110 and 112) in toner cartridge 102. As an example, acoustic controller 118 performs acoustic measurements more frequently when there are more resonant shaping structures in toner cartridge 102.

Example environment 300 illustrates a linear relationship between toner fill level and pages printed; however, this is not construed as a limitation. For example, there can be non-linear relationships between toner fill level and pages printed, such that re-calibration takes into account these non-linear relationships.

As an example, assume that at a 6% page coverage, a toner cartridge will produce X printed pages. However, page coverage does not equate to toner yield, nor can toner yield be extrapolated from page coverage. It cannot be assumed that if page coverage is doubled from 6% to 12% that only X/2 printed pages will be output because there is not a linear relationship between toner usage and page coverage. In the process of producing a printed or copied page, an amount of toner deposited varies based on such factors as ambient temperature and humidity, machine maintenance, manufacturing tolerances of components, machine setup, and the like.

Example Acoustic Controller

Figure 4:
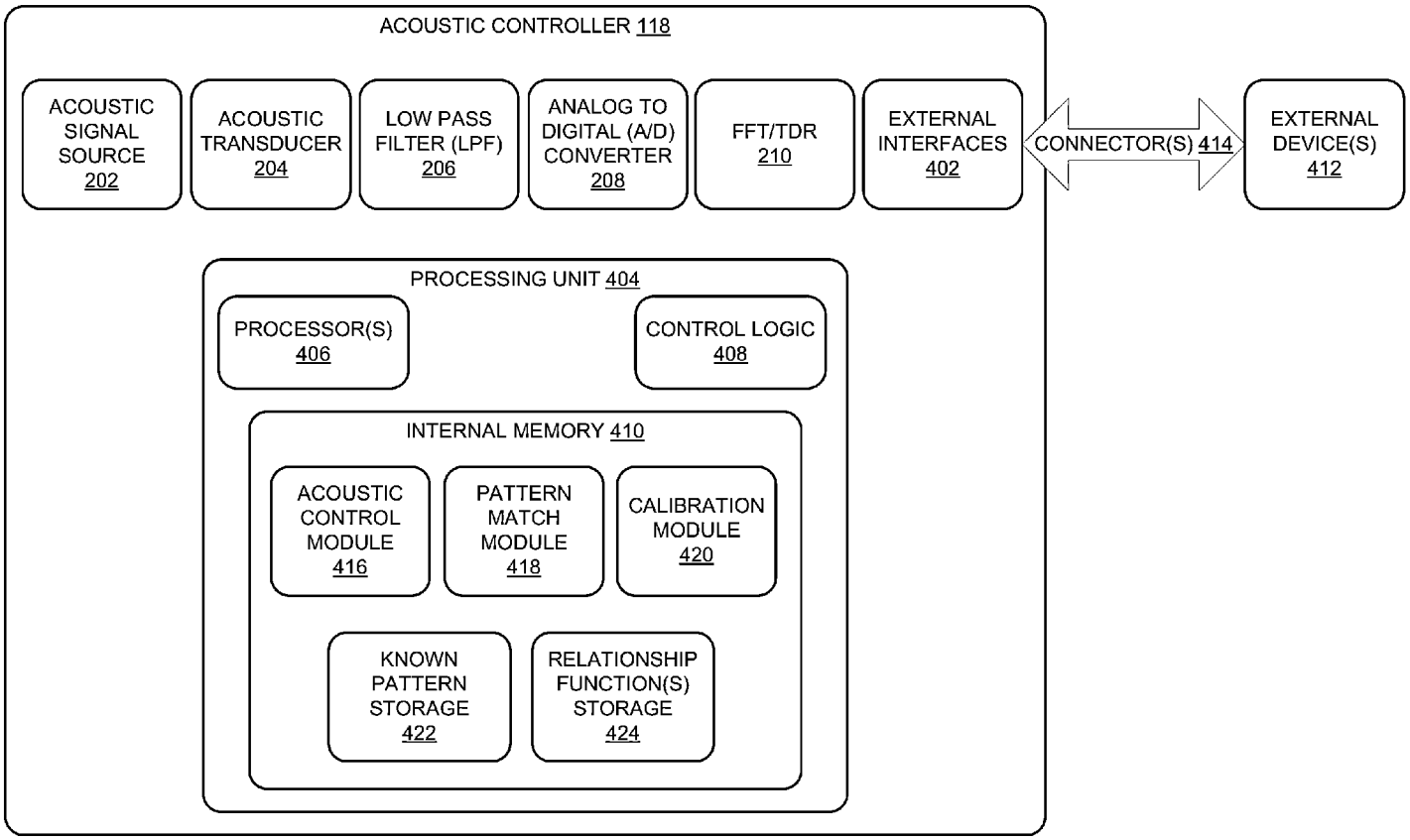
FIG. 4 is a schematic diagram showing example components of an acoustic controller.

FIG. 4 illustrates example implementations of acoustic controller 118. In various embodiments, acoustic controller 118 is a semiconductor based device (e.g., semiconductor chip(s), application-specific integrated circuit (ASIC), system on a chip (SoC), field-programmable gate array (FPGA), and/or the like) that controls and processes acoustic measurements on a toner cartridge, such as toner cartridge 102. In various embodiments, acoustic controller 118 is attached to, or integrated into a toner cartridge, such as toner cartridge 102.

FIG. 4 illustrates an example of various components shown as parts of acoustic controller 118. Such components include an amplified acoustic signal source 202, acoustic transducer 204, LPF 206, A/D converter 208, FFT/TDR 210 (as discussed with regard to FIG. 2.), external interfaces 402 and processing unit 404. In various embodiments, FFT/TDR 210 is implemented by a digital signal processor (DSP).

Processing unit 404 is illustrated as including additional components, such as one or more hardware based processors 406 (e.g., microprocessors, multi-core processors, graphical processing units, or the like), control logic 408 (e.g., digital signal processors (DSPs), FPGAs, custom hardware logic, or the like), and internal memory 410 (e.g., non-volatile memory).

One or more of the various components of acoustic controller 118 can be implemented as external device(s) 412 that interface with acoustic controller 118 through external interfaces 402 via one or more connectors 414 (e.g., bus, peripheral component interconnect (PCI), etc.).

Internal memory 410 is illustrated as storing data and various modules for execution by, for example, processor(s) 406. The various modules include instructions, such as software and/or firmware instructions. Modules illustrated in the example environment of FIG. 4 include acoustic control module 416, pattern match module 418 and calibration module 420.

In various embodiments, acoustic control module 416 is configured to control acoustic signal source 202 and analyze a response provided by FFT/TDR 210 to identify and/or quantify a pattern associated with an acoustic signal received by acoustic transducer 204. Therefore, acoustic control module 416 controls an on/off state of acoustic signal source 202. Thus, acoustic control module 416 determines a frequency of acoustic measurements, based on, for example, a deviation of a measurement relative to an expected measurement, and/or a number of resonant shaping structures in a toner cartridge, as well as other factors.

In various embodiments, acoustic control module 416 shapes the acoustic signal generated by acoustic signal source 202, such that the generated acoustic signal contains frequencies that are optimized for the internal geometries of various different types or models of toner cartridges.

In various embodiments, acoustic control module 416 is configured to facilitate, control and/or replace FFT/TDR 210. In various other embodiments, acoustic control module 416 is configured to work in conjunction with control logic 408 to facilitate, control and/or and or replace FFT/TDR 210.

Pattern match module 418 is configured to match a pattern provided by acoustic control module 416 to a set of known patterns stored in, for example, known pattern storage 422. Pattern match module 418 is configured to associate the pattern provided by acoustic control module 416 to determine a fill level of consumable supplies in the toner cartridge. Pattern match module 418 is configured to use a variety of techniques (e.g., heuristics, neural networks, Bayesian classifiers, probabilistic models, pattern matching algorithms, classification algorithms, and/or the like) to associate the pattern provided by acoustic control module 416 to the fill level of consumable supplies (e.g., CS fill level 116) in the toner cartridge.

Pattern match module 418 is configured to detect resonant shaping structures in received patterns and associate fill levels of consumable supplies in the toner cartridge with corresponding resonant shaping structures. Pattern match module 418 is configured to associate a magnitude of one or more components in a received pattern to a fill level of consumable supplies in the toner cartridge. As an example, in the case where all but a portion of at least one of the resonant shaping structures are completely submerged (e.g., totally covered by consumable supplies in the toner cartridge), pattern match module 418 is configured to associate a magnitude of one or more components in a received pattern to a fill level of consumable supplies in the toner cartridge.

As another example, in the case where at least a portion of one or more resonant shaping structures are revealed (e.g., above a fill level of consumable supplies in the toner cartridge), pattern match module 418 is configured to associate a magnitude of one or more components in a received pattern to a fill level of consumable supplies in the toner cartridge. Thus, pattern match module 418 does not only detect when an internal object is initially revealed during consumption of toner to determine a toner fill level, but is configured to also analyze various features in the pattern (e.g., relative magnitudes of reflections) to determine or estimate a toner fill level. As an example, after internal object 112 has been revealed in the toner, prior to internal object 110 being revealed, pattern match module 418 is configured to analyze various features in the pattern to determine or estimate a current toner fill level. Thus, pattern match module 418 is configured to estimate toner fill levels (e.g., via extrapolation) between internal object 112 being revealed and internal object 110 being revealed by analyzing various features in the pattern.

Calibration module 420 is configured to track a number of refills that have occurred for a corresponding toner cartridge, track a number of output elements (e.g., pages) printed between each initial and end fill levels of a toner cartridge, calibrate and/or re-calibrate a relationship function associated with the toner cartridge and maintain relationship functions in, for example, relationship functions storage 424. Calibration module 420 is configured to retrieve a relationship function from relationship functions storage 424 and use a current fill level determined by pattern match module 418 and a current number of pages printed to calibrate and/or re-calibrate a relationship function associated with the toner cartridge. Calibration module 420 is also configured to service external queries (e.g., via external interfaces 402) to provide requested relationship function information in a response to a requestor. In FIG. 4, processing unit 404, as well as other components of acoustic controller 118, are illustrated as internal parts of acoustic controller 118 attached to toner cartridge 102. However, in various embodiments, various components illustrated in FIG. 4 are not attached to or integrated into toner cartridge 102. As an example, acoustic signal source 202 and acoustic transducer 204 are directly attached to toner cartridge 102, while various other components (e.g., processing unit 404) illustrated in FIG. 4 are external to (e.g., not attached to) toner cartridge 102. Numerous other configurations of components illustrated in FIG. 4 attached to, integrated into, or separate from print cartridge 102 are within the scope of this disclosure.

Internal memory 410 is an example of computer-readable storage media. Computer-readable media includes, at least, two types of computer-readable media, namely computer-readable storage media and communications media.

Computer-readable storage media includes volatile and non-volatile, removable and non-removable media implemented in any method or technology for storage of information such as computer readable instructions, data structures, program modules, or other data. Computer-readable storage media includes, but is not limited to, RAM, ROM, EEPROM, flash memory, cache memory or other memory in RPC-BP decoder 622, or other memory technology, CD-ROM, digital versatile disks (DVD) or other optical storage, magnetic cassettes, magnetic tape, magnetic disk storage or other magnetic storage devices, or any other non-transmission medium that can be used to store information for access by a computing device.

In contrast, communication media may embody computer-readable instructions, data structures, program modules, or other data in a modulated data signal, such as a carrier wave, or other transmission mechanism. As defined herein, computer storage media does not include communication media.

Example Methods

Figure 5:
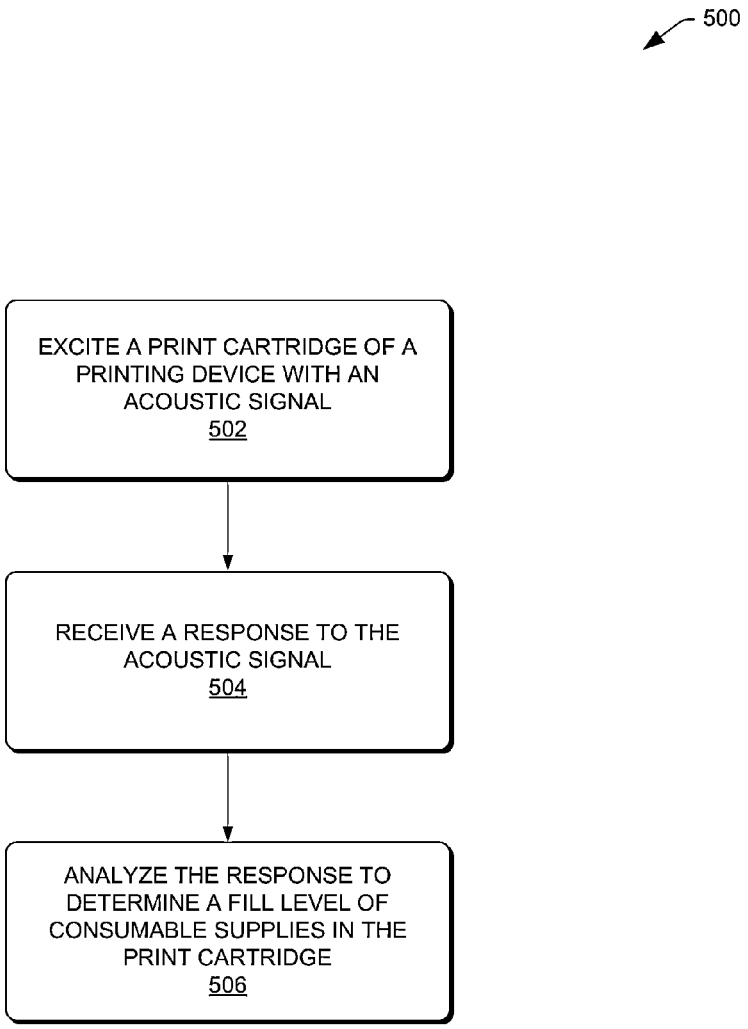
FIG. 5 is a flowchart illustrating an example acoustic measurement process.

FIG. 5 illustrates an example method 500 of acoustically determining a fill level of consumable supplies in a toner cartridge.

At block 502, a toner cartridge of a printing device is excited with an acoustic signal. As an example, the acoustic signal is generated by acoustic signal source 202 that is attached to or integrated into toner cartridge 102. A shape of the acoustic signal (e.g., duration, amplitude, amplitude variations, frequency components, etc.) is determined by the hardware implementation of acoustic signal source 202, and/or processing unit 404. In various embodiments, the acoustic signal is shaped based at least in part on a known internal geometry of the toner cartridge, such as known resonances associated with an internal shape of the toner cartridge and resonant shaping structures built into the toner cartridge. As an example, acoustic signal source 202 generates a swept chirp signal, ping, pulse, shaped pulse, impulse(s), or the like, to excite known available resonances in an internal cavity of toner cartridge 102.

At block 504, a response to the acoustic signal is received. As an example, the response is received by acoustic transducer 118 that is attached to the toner cartridge and/or integrated into the toner cartridge.

At block 506, the response is analyzed to determine a current fill level of consumable supplies in the toner cartridge. As an example, the response is analyzed by processing unit 404 that is attached to the toner cartridge, integrated into the toner cartridge and/or external to the toner cartridge. The response is analyzed at least in part by performing a frequency domain conversion of the response, and/or determining a time domain reflection of the response. Thus, FFT/TDR 210 generates a pattern associated with the response in the time and/or the frequency domain.

Analyzing the response further includes pattern matching a pattern in the response to one or more known patterns associated with known fill levels of the consumable supplies in the toner cartridge. As an example, FFT/TDR 210 transforms the response to a spectral pattern by performing an FFT, and processing unit 404 compares the spectral pattern to known spectral patterns associated with known fill levels of consumable supplies in the toner cartridge. A current fill level of consumable supplies in the toner cartridge is determined based at least in part on the comparison of the spectral pattern to known spectral patterns. As an example, pattern match module 418 compares a pattern from acoustic control module 416, compares the pattern to known patterns stored in known pattern storage 422 that are associated with known fill levels of consumable supplies in the toner cartridge, and infers a current fill level of consumable supplies in the toner cartridge.

At least some of the known patterns stored in known pattern storage 422 are associated with known resonant shaping structures built into the toner cartridge. Therefore, as an example, processing unit 404 detects, in the response received by acoustic transducer 204, a resonant shaping structure submerged in the consumable supplies at a current fill level of consumable supplies that reveals at least a portion of the resonant shaping structure. Then, processing unit 404 associates the current fill level of consumable supplies in the toner cartridge to a known fill level corresponding to the known resonant shaping structure.

As described herein, processing unit 404 maintains relationship functions in storage, and calibrates and/or recalibrates relationship functions to improve an estimation of a remaining number of pages that can be printed based on a determined fill level of toner remaining in the toner cartridge. As an example, calibrated and recalibrated relationship functions are associated with relationship lines 308 and 314, respectively, in FIG. 3. Therefore, processing unit 404 determines a number of output elements printed by the printing device corresponding to a difference between an initial fill level of the toner cartridge and a current fill level (e.g., determined level of toner), and based at least in part on the current fill level and the number of output elements printed by the printing device, calibrates a relationship function used to estimate a remaining number of output elements associated with an end fill level of the toner cartridge. Processing unit 404 also maintains the calibrated relationship function after refilling the toner cartridge. As described herein, processing unit 404 performs these calibrations to continuously improve an estimate of a remaining number of output elements associated with an end fill level of the toner cartridge.

As described herein, processing unit 404 performs acoustic measurements on a predetermined periodic basis, or at intervals determined by processing unit 404. As an example, if the number of printed pages at point 306 of FIG. 3 deviates from the estimated number of printed pages on relationship line 302, processing unit 404 increases the frequency of acoustic measurements. In various embodiments, processing unit 404 changes the frequency of acoustic measurements as a function of the deviation between point 306 and the associated estimated number of pages printed indicated by relationship line 302. Additionally, processing unit 404 changes the frequency of acoustic measurements as a function of a number of resonant shaping structures (e.g., internal objects 110 and 112) in toner cartridge 102. As an example, acoustic controller 118 performs acoustic measurements more frequently when there are more resonant shaping structures in toner cartridge 102.

Thus, processing unit 404 compares the current fill level (e.g., that corresponds to a volume of consumable supplies determined by processing unit 404) to an estimate of the current fill level obtained by a relationship function associated with the toner cartridge, and adjusts a frequency of occurrence of the acoustic measurements (e.g., exciting the toner cartridge with an acoustic signal, receiving a response to the acoustic signal and analyzing the response to determine a current fill level of consumable supplies in the toner cartridge) based at least in part on a difference between the current fill level and the estimate of the current fill level. Processing unit 404 also maintains a number of times the toner cartridge has been refilled.

Conclusion

Note that the description above incorporates use of the phrases "in an aspect," "in an embodiment," or "in various embodiments," or the like, which may each refer to one or more of the same or different embodiments. Furthermore, the terms "comprising," "including," "having," and the like, as used with respect to embodiments of the present disclosure, are synonymous.

As used herein, the terms "logic," "component," and "module" may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality. The logic and functionality described herein may be implemented by any such components.

In accordance with various embodiments, an article of manufacture may be provided that includes a storage medium having instructions stored thereon that, if executed, result in the operations described above. In an embodiment, the storage medium comprises some type of non-transitory memory (not shown). In accordance with various embodiments, the article of manufacture may be a computer-readable medium such as, for example, software or firmware.

Various operations may have been described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

Although the present disclosure describes embodiments having specific structural features and/or methodological acts, it is to be understood that the claims are not necessarily limited to the specific features or acts described. Rather, the specific features and acts are merely illustrative some embodiments that fall within the scope of the claims of the present disclosure.

What is claimed is:

1. A method for determining an amount of toner remaining within a toner cartridge, wherein the toner remaining within the toner cartridge is useable by a printing device to print one or more documents, the method comprising:

exciting the toner cartridge with an acoustic signal;

based on having excited the toner cartridge with the acoustic signal, receiving a response to the acoustic signal; and using a processing unit integrated into the toner cartridge to analyze the response to the acoustic signal to determine the amount of toner remaining in the toner cartridge.

2. The method of claim 1, further comprising:

determining a number of documents printed by the printing device corresponding to a difference between (i) an initial fill level of toner in the toner cartridge and (ii) a current level of toner in the toner cartridge; and based at least in part on (i) the current level of toner in the toner cartridge and (ii) the number of documents printed by the printing device, calibrating a relationship function used to estimate a remaining number of documents associated with an end fill level of toner in the toner cartridge.

3. The method of claim 2, further comprising:

maintaining the calibrated relationship function after refilling the toner cartridge.

4. The method of claim 1, further comprising:

detecting, in the response, a resonant shaping structure submerged in the toner at a current level of toner in the toner cartridge that reveals at least a portion of the resonant shaping structure; and associating the current level of toner in the toner cartridge to a known fill level of toner in the toner cartridge corresponding to the resonant shaping structure.

5. The method of claim 4, further comprising:

determining a number of documents printed by the printing device corresponding to a difference between (i) an initial fill level of toner in the toner cartridge and (ii) the current level of toner in the toner cartridge; and based at least in part on (i) the current level of toner in the toner cartridge and (ii) the number of documents printed by the printing device, estimating a remaining number of documents associated with an end fill level of toner in the toner cartridge.

6. The method of claim 1, wherein the acoustic signal for exciting the toner cartridge is shaped based at least in part on a known internal geometry of the toner cartridge.

7. The method of claim 1, wherein the analyzing the response includes at least one of:

performing a frequency domain conversion of the response; or determining a time domain reflection of the response.

8. The method of claim 1, wherein the analyzing the response includes pattern matching a pattern in the response to one or more known patterns associated with known fill levels of the toner in the toner cartridge.

9. The method of claim 1, wherein the analyzing the response includes:

transforming the response to a spectral pattern; and comparing the spectral pattern to known spectral patterns associated with known fill levels of toner in the toner cartridge.

10. The method of claim 9, wherein the current level is determined based at least in part on the comparing the spectral pattern to known spectral patterns associated with known fill levels of toner in the toner cartridge.

11. The method of claim 1, further comprising maintaining a number of times the toner cartridge has been refilled with toner.

12. The method of claim 1, wherein a current level of toner in the toner cartridge corresponds to a volume of toner in the toner cartridge.

13. A method for determining an amount of toner remaining within a toner cartridge, wherein the toner remaining within the toner cartridge is useable by a printing device to print one or more documents, the method comprising:

exciting the toner cartridge with an acoustic signal;

based on having excited the toner cartridge with the acoustic signal, receiving a response to the acoustic signal;

analyzing the response to the acoustic signal to determine the amount of toner remaining in the toner cartridge;

comparing a current level of toner in the toner cartridge to an estimate of the current level of toner in the toner cartridge obtained by a relationship function associated with the toner cartridge; and adjusting a frequency of occurrence of the exciting, wherein both (i) the receiving the response to the acoustic signal and (ii) the analyzing the response are based at least in part on a difference between (i) the current level of toner in the toner cartridge and (ii) the estimate of the current level of toner in the toner cartridge.

14. An acoustic controller comprising:

an acoustic signal source configured to excite a toner cartridge of a printing device with an acoustic signal;

an acoustic transducer configured to receive a response to the acoustic signal; and a processing unit configured to:

analyze the response to determine a current level of consumable supplies in the toner cartridge;

detect, in the response, a resonant shaping structure submerged in the consumable supplies at the current level of consumable supplies in the toner cartridge that reveals at least a portion of the resonant shaping structure;

associate the current level of consumable supplies in the toner cartridge to a known fill level of consumable supplies in the toner cartridge corresponding to the resonant shaping structure;

determine a number of output elements printed by the printing device corresponding to a difference between (i) an initial fill level of consumable supplies in the toner cartridge and (ii) the current level of consumable supplies in the toner cartridge;

based at least in part on (i) the current level of consumable supplies in the toner cartridge and (ii) the number of output elements printed by the printing device, calibrate a relationship function used to estimate a remaining number of output elements associated with (i) the current level of consumable supplies in the toner cartridge and (ii) an end fill level of consumable supplies in the toner cartridge; and maintain the calibrated relationship function in storage for use after the toner cartridge has been refilled.

15. The acoustic controller of claim 14, wherein the acoustic controller is one of (i) attached to the toner cartridge or (ii) integrated into the toner cartridge.

16. A toner cartridge comprising an acoustic controller that is one of (i) attached to the toner cartridge or (ii) integrated into the toner cartridge, wherein the acoustic controller is configured to:

excite the toner cartridge with an acoustic signal;

receive a response to the acoustic signal;

analyze the response to determine a current level of consumable supplies in the toner cartridge; and utilize the current level of consumable supplies in the toner cartridge to calibrate a relationship function used to estimate a remaining number of output elements for printing, wherein the remaining number of output elements for printing is associated with (i) the current level of consumable supplies in the toner cartridge and (ii) an end fill level of consumable supplies in the toner cartridge.

17. The toner cartridge of claim 16, wherein the acoustic controller is further configured to determine the current level of consumable supplies in the toner cartridge by acoustically detecting at least a portion of a resonant shaping structure submerged in the consumable supplies when the consumable supplies have been consumed to the current level of consumable supplies in the toner cartridge.

18. A method for determining an amount of toner remaining within a toner cartridge, wherein the toner remaining within the toner cartridge is useable by a printing device to print one or more documents, the method comprising:

exciting the toner cartridge with an acoustic signal;

based on having excited the toner cartridge with the acoustic signal, receiving a response to the acoustic signal;

analyzing the response to the acoustic signal to determine the amount of toner remaining in the toner cartridge;

determining a number of documents printed by the printing device corresponding to a difference between (i) an initial fill level of toner in the toner cartridge and (ii) a current level of toner in the toner cartridge; and based at least in part on (i) the current level of toner in the toner cartridge and (ii) the number of documents printed by the printing device, calibrating a relationship function used to estimate a remaining number of documents associated with an end fill level of toner in the toner cartridge.

* * * * *